United States Patent [19]

Gaston

[11] 4,334,872

[45] Jun. 15, 1982

[54] MOTOR BOAT

[76] Inventor: William D. Gaston, 2508 Pecos, Austin, Tex. 78703

[21] Appl. No.: 939,134

[22] Filed: Sep. 8, 1978

Related U.S. Application Data

[63] Continuation-in-part of Ser. No. 840,721, Oct. 11, 1977, abandoned.

[51] Int. Cl.[3] ..... B63H 5/12

[52] U.S. Cl. ..... 440/61

[58] Field of Search ..... 115/41 R, 41 HT, 34 R, 115/35, 39; 440/49, 51, 52, 53, 55, 56, 61, 65

[56] References Cited

U.S. PATENT DOCUMENTS

| | | | |
|---|---|---|---|
| 1,745,354 | 2/1930 | Collins | 115/41 R |
| 2,742,013 | 4/1956 | Daniels | 115/41 R |
| 2,856,883 | 10/1958 | Baker | 115/41 R |
| 2,949,791 | 8/1960 | Cattaneo et al. | 115/41 R |
| 4,089,289 | 5/1978 | Sauder | 115/41 R |

FOREIGN PATENT DOCUMENTS

| | | | |
|---|---|---|---|
| 861810 | 1/1953 | Fed. Rep. of Germany | 115/41 R |
| 439749 | 2/1912 | France | 115/41 R |

*Primary Examiner*—Trygve M. Blix
*Assistant Examiner*—Jesús D. Sotelo
*Attorney, Agent, or Firm*—Vaden, Eickenroht, Thompson, Bednar & Jamison

[57] ABSTRACT

There is disclosed a motor boat having a propulsion and steering system which includes a propeller mounted on a housing which is supported from the boat transom for rotation about a generally vertical axis to steer the boat, and for reciprocation along a generally vertical axis to permit the propeller to be raised and lowered between normal operating, retracted and trim positions, and wherein a motor is mounted in the hull and connected to the propeller shaft by a drive shaft extending sealably through a hole in the hull and having joints at its opposite ends to enable the housing to be so moved.

45 Claims, 15 Drawing Figures

38A
39A
35A
24A

SA
34A
25A
20A
23A
21A
30A
27A
31A 34A
45A
20
24A
25A
21A
30A
27A
23A
31A

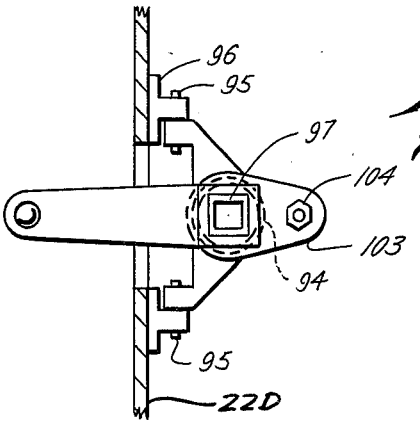
Fig. 13
Fig. 14
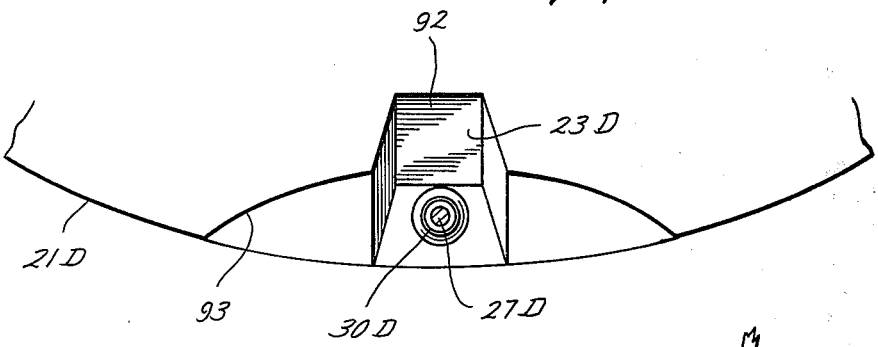
Fig. 15
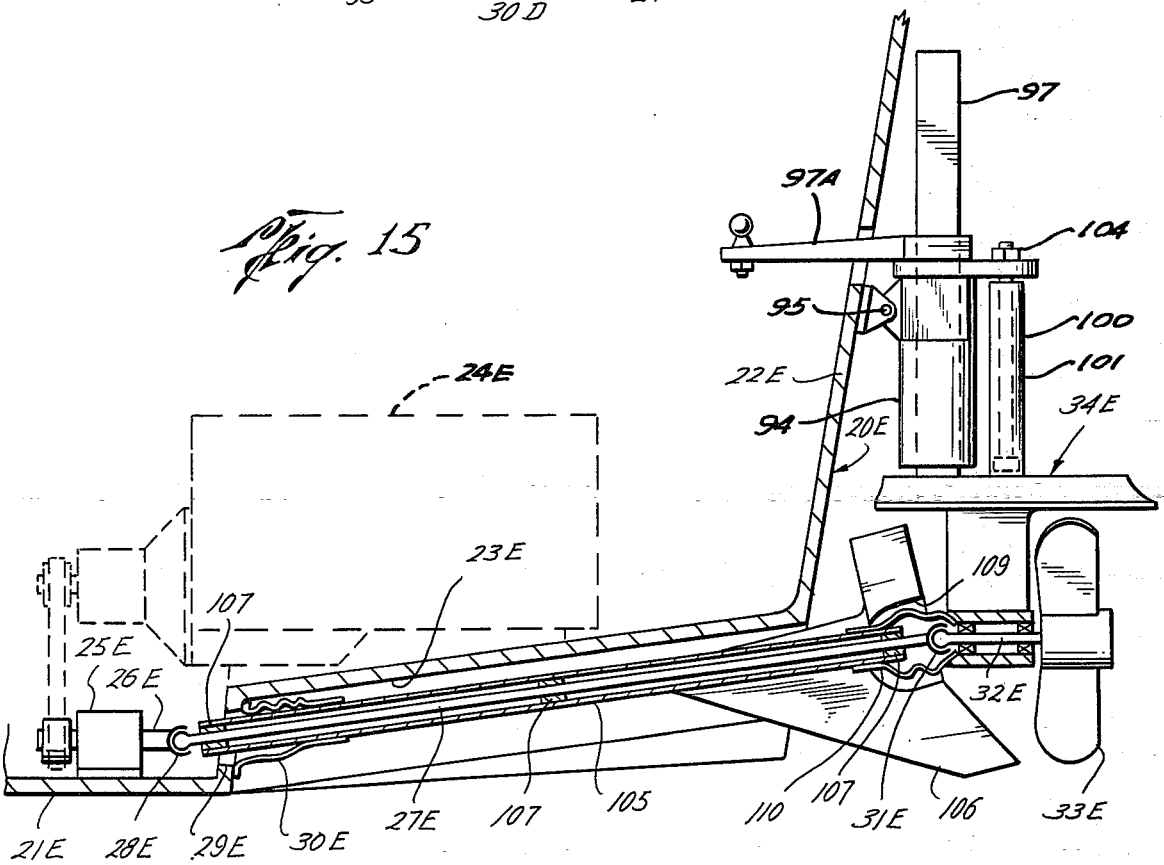

MOTOR BOAT

This application is a continuation-in-part of my copending application, Ser. No. 840,721, filed Oct. 11, 1977, entitled Motor Boat, now abandoned.

This invention relates generally to a motor boat; and, more particularly, to a motor boat having an improved propulsion and steering system.

Of the three basic types of conventional propulsion and steering systems, the inboard type is very efficient since the motor is mounted in the boat hull and connects to the propeller shaft by means of a drive shaft extending through the hull, and thus is normally a four cycle engine. However, it must rely on a rudder for steering purposes, and, since its underwater parts are not retractable, they do not permit shallow water operation and are susceptible to damage due to obstructions in the water.

In the outboard type of propulsion and steering system, the boat is steered by manipulation of a motor supported on the transom of the hull. Also, the motor is free to swing upwardly for shallow water operations and out of the way of obstructions. However, the large opening which must be cut out of the upper end of the transom to permit the motor to be swung upwardly increases the risk of flooding. Also, the transom is normally capable of supporting only a two cycle engine, which is less fuel efficient than the four cycle engines mounted in the boat hulls of inboard types.

The so-called inboard-outboard or stern drive system was more recently devised for the purpose of using the best features of both the inboard and outboard systems. Thus, it uses a four cycle engine which is mounted in the boat hull and an articulated drive shaft including a portion extending through a hole in the transom to connect the motor to the propeller shaft in a manner which permits the propeller to be turned to steer the boat or retracted out of the way of obstructions or for operation in shallow water. In addition, in some systems of this type, the propeller shaft may be raised to a position in which it forms a small angle with the bottom of the boat, and thus dispose the propeller in a "trim" position to increase the speed of the boat under certain operating conditions. However, the mechanism for connecting the motor to the propeller shaft is complex and expensive and includes many parts in the water which are susceptible to damage, maintenance and repair problems.

The primary object of the present invention is to provide a propulsion and steering system which obviates the above-noted shortcomings of prior systems, while, at the same time, retaining the advantages of each.

More particularly, it is an object of this invention to provide such a system which is similar to the outboard and stern drive systems in that it does not require a rudder for steering purposes, and further in that it enables the propeller and other parts thereof to be retracted to positions for avoiding damage by underwater obstructions; which is similar to the inboard and stern drive systems in that it does not require a large opening to be cut out of the upper end of the transom, and further in that it permits the use of a fuel efficient four cycle engine; and which is similar to the inboard and outboard systems in that the connection between its motor and propeller shaft is relatively simple and inexpensive, and further does not require underwater parts which are especially susceptible to damage, maintenance and repairs.

These and other objects are accomplished, in accordance with the illustrated embodiments of the present invention, by a motor boat in which, as in an inboard type system, the motor is mounted in the hull of the boat, and may be a four cycle engine, but wherein, as in an outboard system, the housing on which the propeller shaft is rotatably mounted is supported from the hull rearwardly of the transom in such a manner that it may be rotated about a substantially vertical axis for steering purposes and moved vertically along such axis to permit the propeller to be retracted and/or trimmed. More particularly, and as compared with stern drive systems, the propeller is connected to the motor by means which extends sealably through a hole in the hull and includes a drive shaft having a flexible joint on one end near the hole to permit the housing to swing about a horizontal axis, and a universal joint at its opposite end connected with the propeller shaft to permit the housing to swing about a generally vertical axis for steering purposes. Consequently, the propeller may be moved between its lowermost position during normal operating conditions, and a fully raised position, in which it is retracted for transport purposes as well as to avoid obstructions, and an intermediate trim position.

In the preferred and illustrated embodiments of the invention, the drive shaft extends through the hole in the hull so as to dispose the flexible joint of the drive shaft inboard of the hole and a means is mounted on the hull about the hole to form a flexible seal about the shaft, whereby such joint need not be otherwise sealed. In accordance with certain embodiments of the invention, the hull has a tunnel in the bottom thereof, and the hole through which the shaft extends is through the forward end of the tunnel, whereby the drive shaft may move upwardly into the tunnel when the propeller is retracted. In another embodiment of the invention, the shaft is shorter and extends through a hole in the transom of the boat hull near its bottom to eliminate the need for the tunnel in the hull.

In certain embodiments of the invention, the flexible joint near the hole in the hull is a universal joint, similar to the universal joint connecting the shaft to the propeller shaft, while in another embodiment of the invention, the flexible joint is instead a right angle gear box which is mounted in the hull for tilting about the axis of its input shaft connected with the output of the motor, and the drive shaft leading to the propeller shaft is an extension of the output shaft of the gear box.

In certain embodiments of the invention, the drive shaft is of fixed length intermediate its forward and rearward joints, whereby this length determines the path in which the propeller housing swings about the forward "U" joint. In another embodiment of the invention, this path is instead determined by a control arm which has a forward end connected to the hull for swinging about a horizontal axis transverse to the length of the hull, and a rearward end which is universally connected to the housing, thereby providing a means separate from the shaft for absorbing shock loads and thrust from the propeller, and the shaft includes telescoping connections intermediate the joints thereof to permit its effective length to vary.

In certain embodiments of the invention, the means for supporting the propeller housing includes a sleeve mounted on the transom for pivoting about a horizontal axis generally transverse to the length of the hull, a post is carried by the sleeve for rotation about a substantially vertical axis, and an arm on the post extends through the transom of the boat hull for manipulation from within the hull. More particularly, a means is provided for connecting the housing to the post for rotation therewith and for vertical reciprocation with respect thereto.

In one form, this latter connecting means comprises links pivotally connected to one another and to the post and housing for pivoting about horizontal axes generally transverse to the length of the hull, and, in another form, it comprises a spline between the sleeve and post. Preferably, the post is tubular, and the connecting means also includes, in one embodiment, an extendible and contractable actuator within the post having its ends connected to the post and the housing. In another embodiment of the invention, the connecting means includes an extendible and retractable actuator within the tubular post which has one end connected to the housing and the post and the other end connected to the sleeve. In each case, retraction of the actuator lifts the post and thus the propeller.

In another embodiment of the invention, the means for supporting the housing from the hull includes a generally vertically extending guide on the transom, a slide guidably slidable on the guide, and means connecting the housing to the slide in such a manner that it may be rotated with respect thereto and vertically reciprocated therewith. More particularly, such connecting means also includes means for reciprocating the housing with respect to the slide to raise and lower the propeller. For this purpose, the connecting means includes an extendible and retractable actuator having its upper end pivotally connected to the slide and its lower end rotatable with respect to the upper end and fixedly connected to the housing, the steering arm is rotatably mounted on the upper end of the actuator, and links are connected to one another and to the arm and the lower end of the actuator for pivoting about horizontal axes generally transverse to the lengths of the hull, whereby the steering motion of the arm is transmitted to the housing, and thus to the propeller.

In still other embodiments of the invention, the means for supporting the housing from the hull is similar to that of certain of the previously described embodiments in that it includes a sleeve mounted on the transom for pivoting about a horizontal axis generally transverse to the length of the hull, and a post carried by the sleeve for rotation about a substantially vertical axis and having an arm thereon which extends through the transom of the boat hull for manipulation from within the hull. In these and other embodiments, however, the post is vertically reciprocable with respect to the sleeve along the substantially vertical axis, and the housing is connected to the post for rotation and reciprocation with it. More particularly, means are also provided for reciprocating the housing with respect to the sleeve in order to raise and lower the propeller. In the illustrated form of this embodiment, this latter means comprises an extendible and retractable actuator disposed in side-by-side relation with the sleeve and post, with one end of the actuator being connected to the housing and the other end being so connected to the sleeve that, when the actuator is extended, the post is free to rise in the sleeve, and when the actuator is moved from extended to retracted position, the post is raised within the sleeve.

In the drawings, wherein like reference characters are used throughout to designate like parts:

Figure 1:
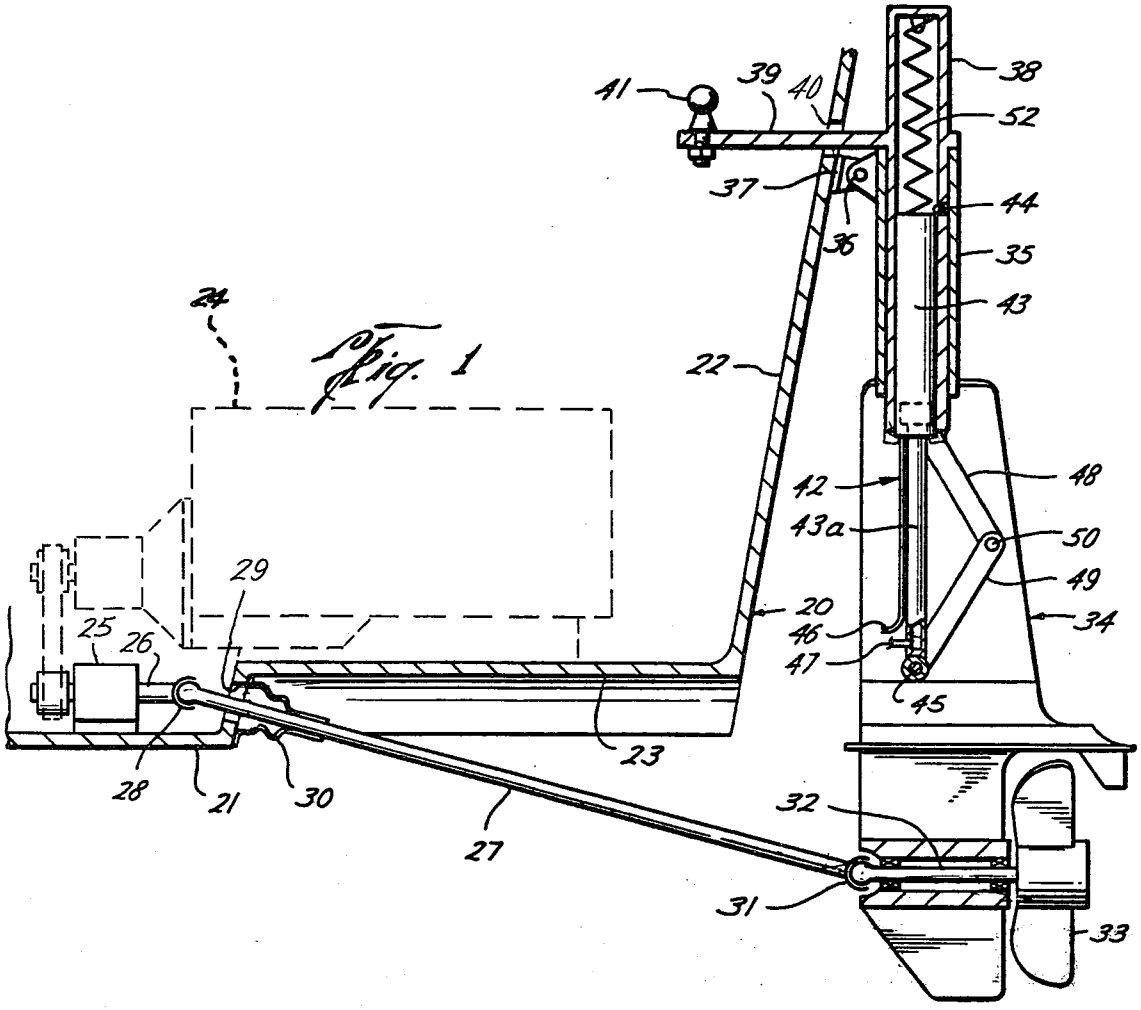
FIG. 1 is a vertical cross-sectional view of the aft end of a boat having a steering and propulsion system constructed in accordance with one of the above-described embodiments, and including an actuator in extended position to lower the propeller to normal operating position.
Figure 3:
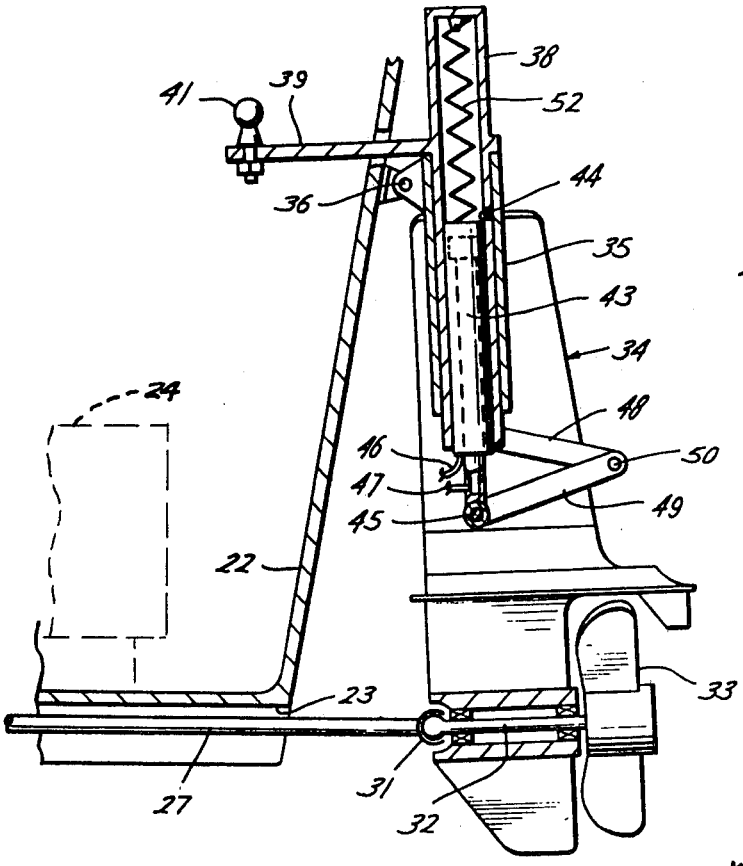
FIG. 3 is another vertical sectional view of the aft end of the boat and steering and propulsion system of FIG. 1, but with the actuator retracted so as to raise the propeller to its retracted position.
Figure 4:
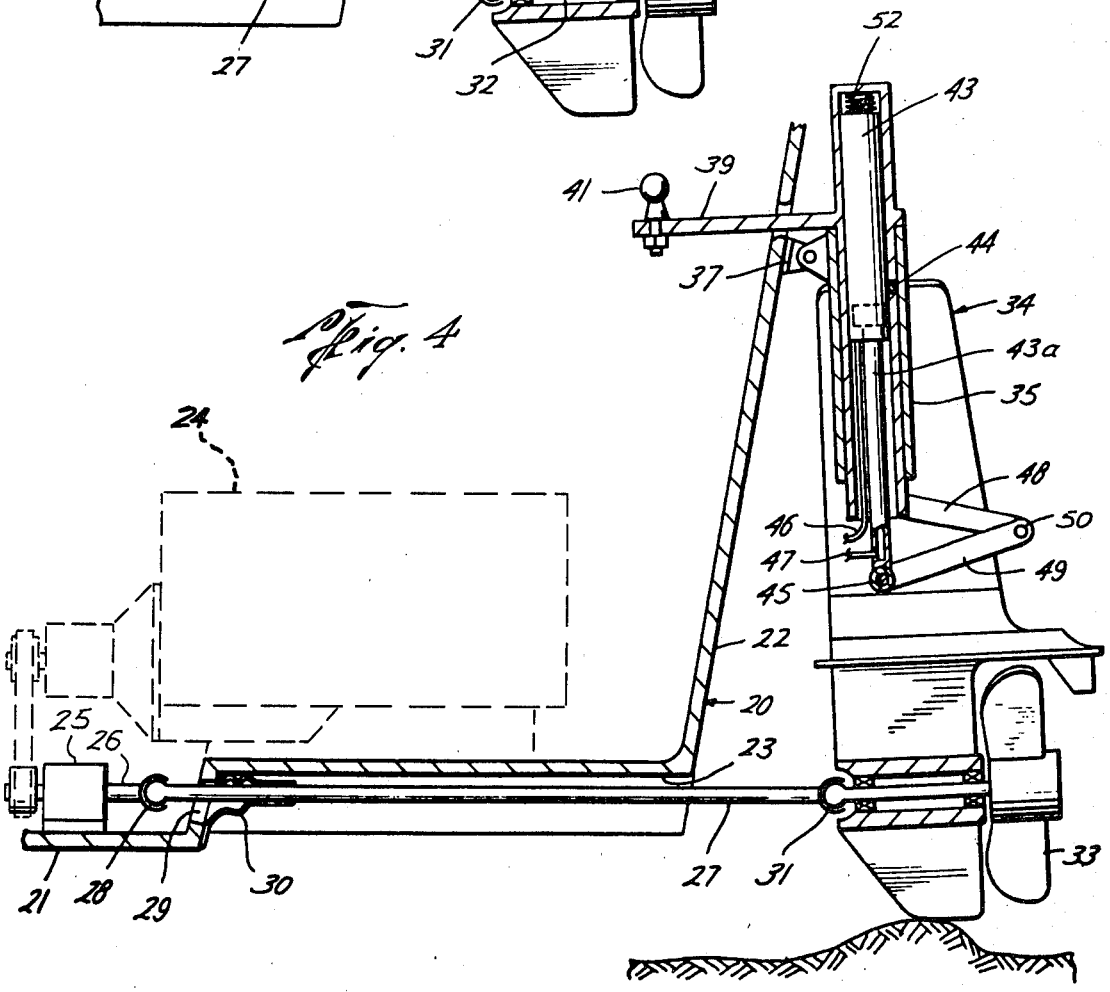
FIG. 4 is another view similar to FIG. 1, but with the propeller forced upwardly by engagement with an obstruction in the water.
Figure 5:
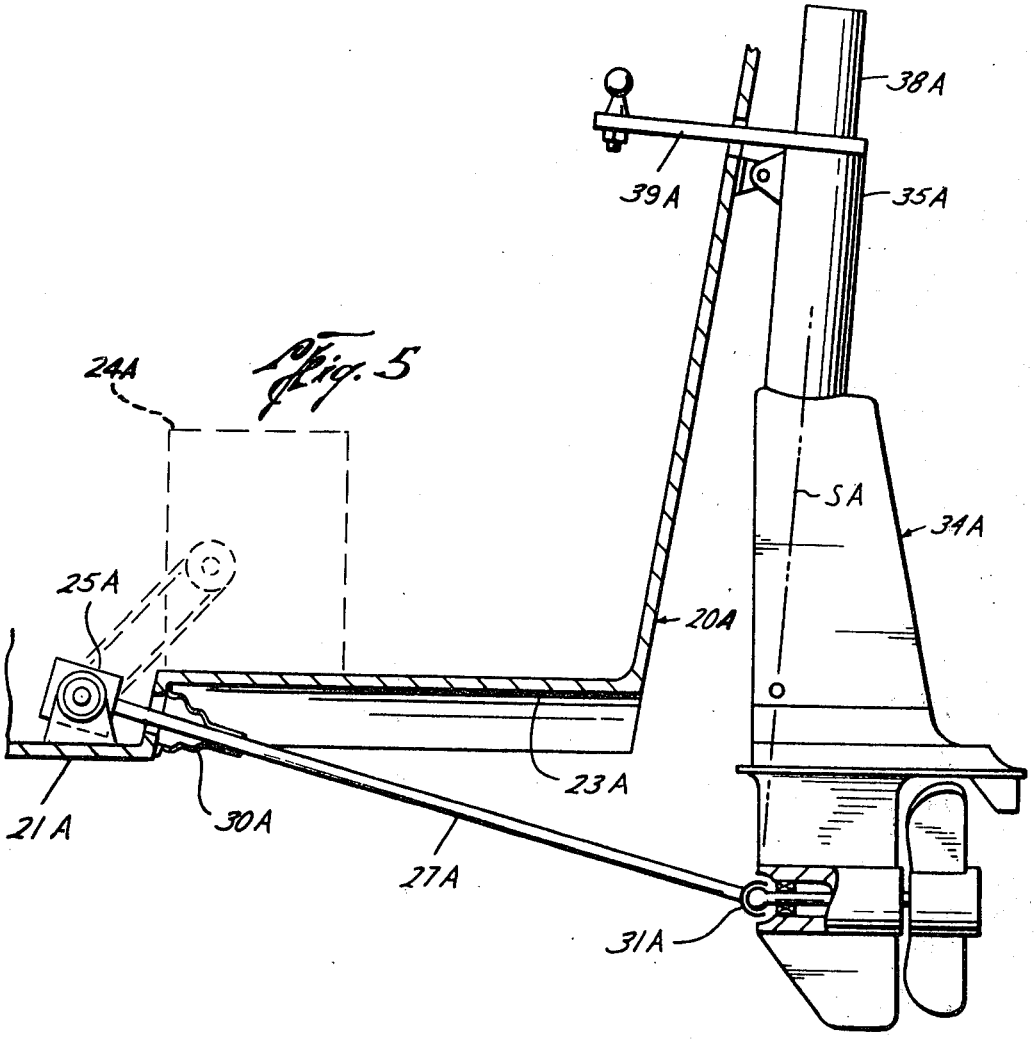
Figure 6:
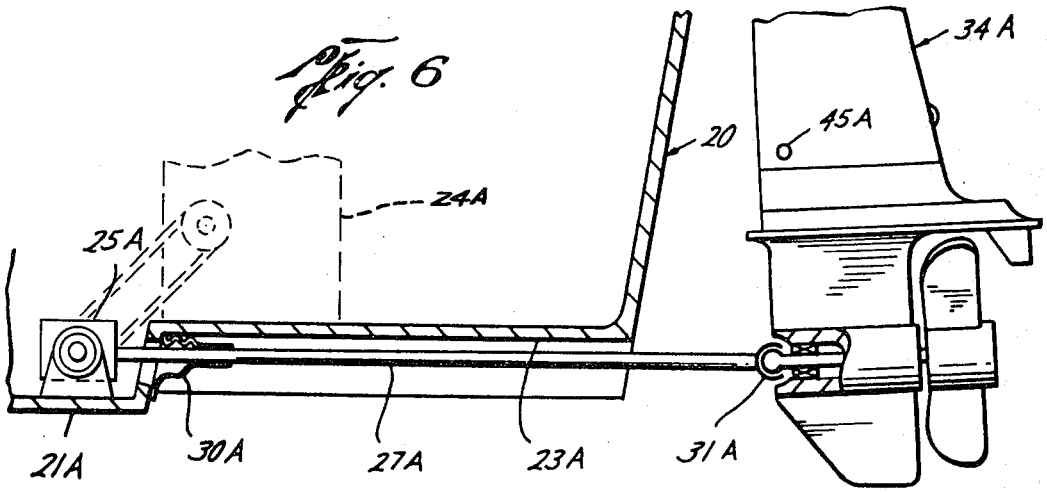
Figure 8:
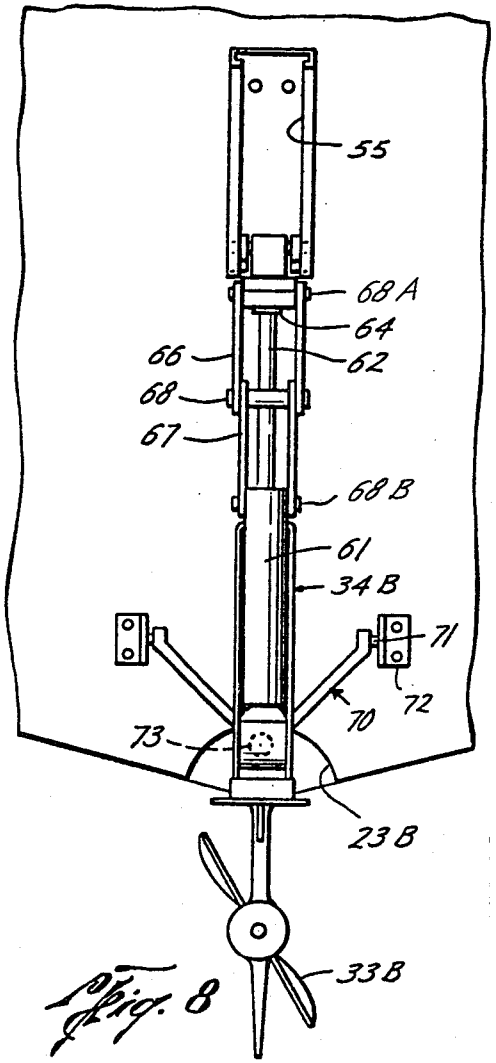
Figure 7:
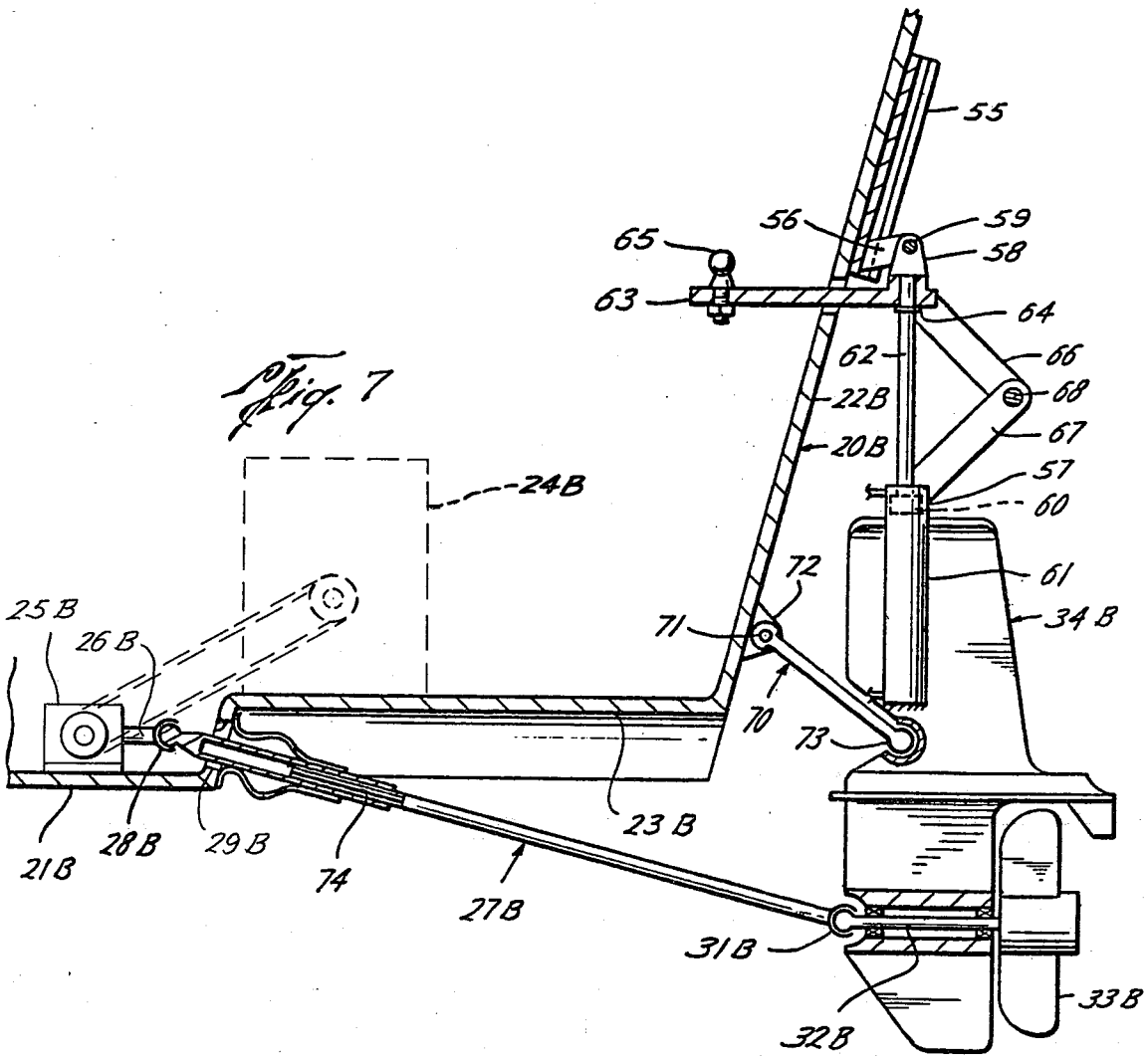
Figure 10:
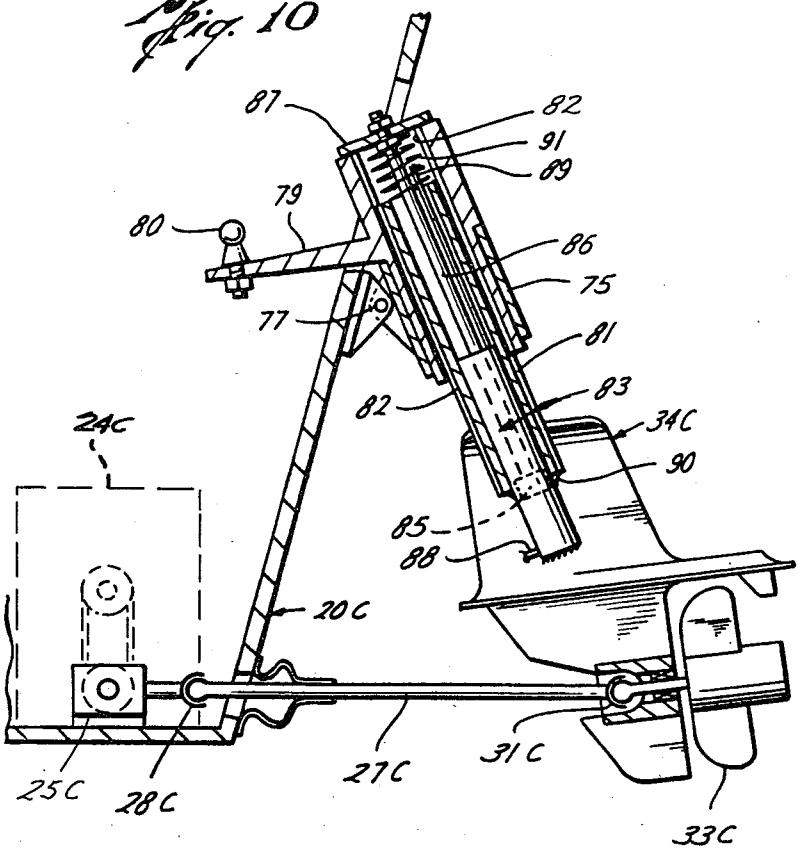
Figure 9:
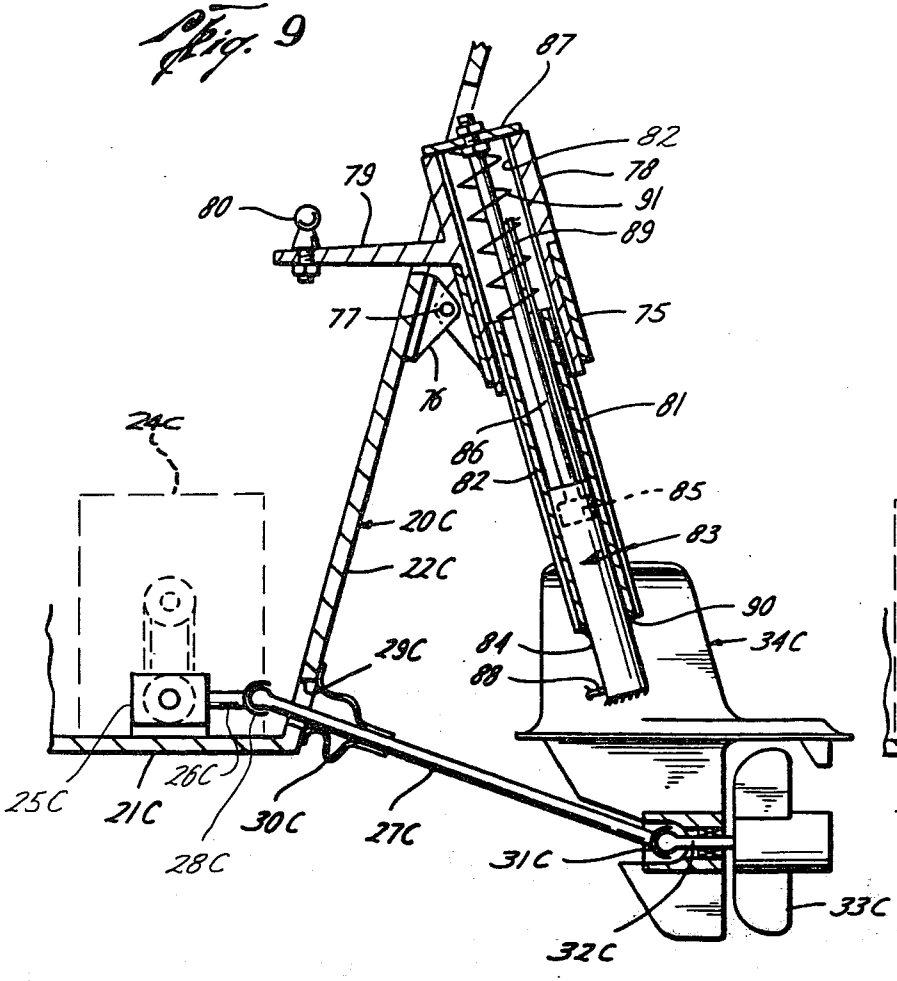
Figure 11:
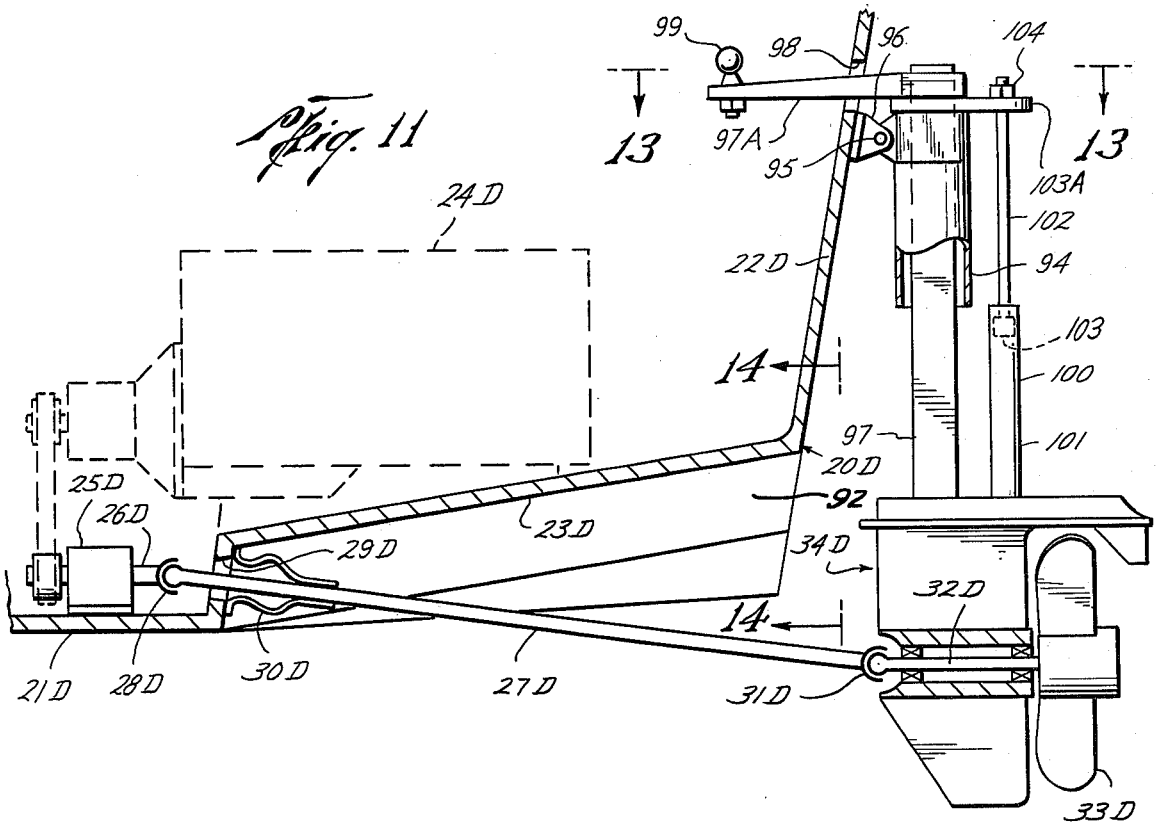
Figure 12:
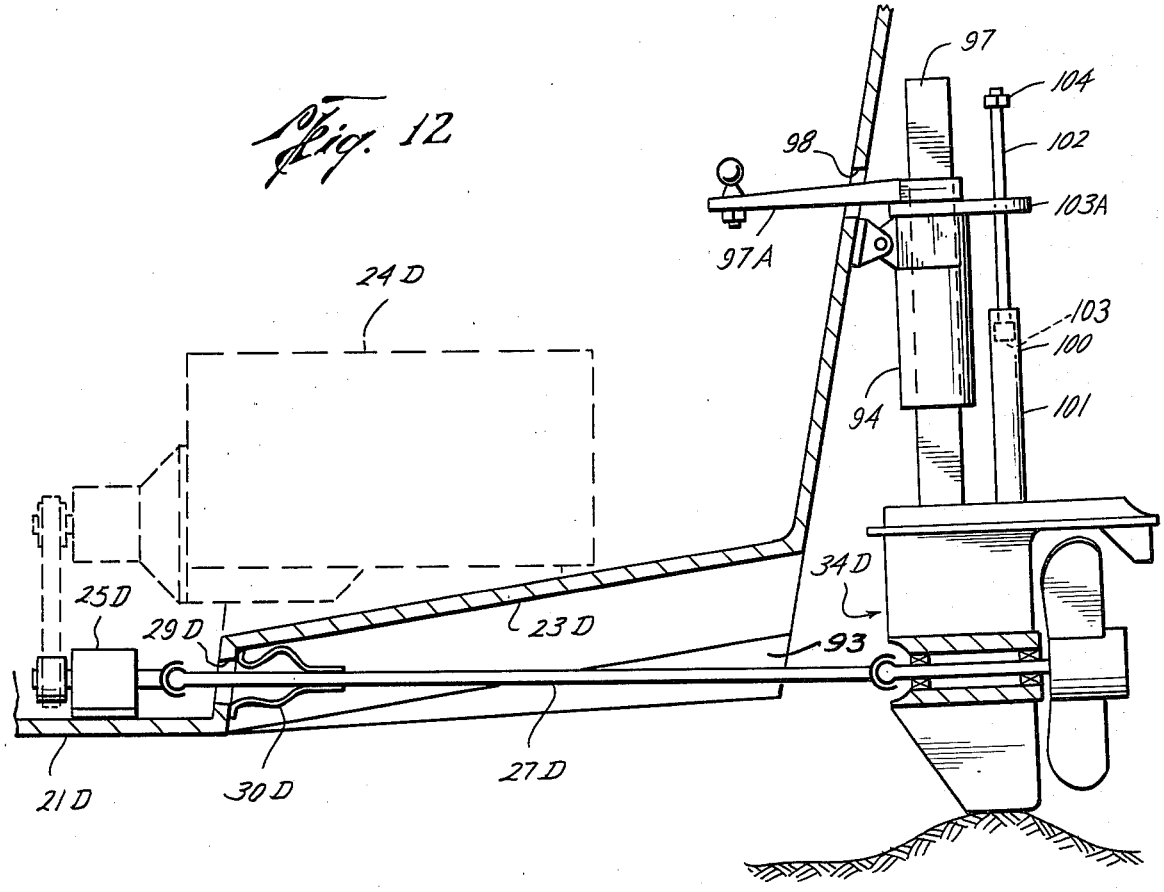

FIG. 5 is a vertical sectional view of the aft end of a boat having a steering and propulsion system constructed in accordance with another embodiment of the invention, which is similar in many respects to the embodiment of FIGS. 1 to 4, with the actuator of the supporting means being shown in an extended position similar to that of FIG. 1 so as to dispose the propeller in its lower operating position;

FIG. 6 is a similar view of the boat and system of FIG. 5, but upon retraction of the actuator, as in FIG. 3, so as to raise the propeller to retracted position;

FIG. 7 is a vertical sectional view of a boat having a steering and propulsion system constructed in accordance with a further embodiment of the invention, wherein the movement of the propeller housing is controlled by an arm connecting it with the transom and the shaft has a telescoping joint, and with the actuator shown in extended position so as to dispose the propeller in its normal operating position;

FIG. 8 is a rear end view of the transom of the boat and the steering and propulsion system of FIG. 7;

FIG. 9 is a vertical sectional view of a boat having a steering and propulsion system constructed in accordance with still another embodiment of the present invention, wherein the shaft extends through a hole in the transom near the bottom of the hull, and with the actuator of the means for supporting the propeller housing in an extended position so as to dispose the propeller in its normal operating position;

FIG. 10 is a similar view of the embodiment of FIG. 9, but with the actuator retracted so as to lift the propeller to a retracted position;

FIG. 11 is a vertical sectional view of a boat having a steering and propulsion system constructed in accordance with one form of the last-described embodiments of the invention, wherein a post connected to the shaft is carried by a sleeve for rotation and reciprocation with respect thereto, and an actuator disposed in side-by-side relation to the post and sleeve is in an extended position to lower the propeller to its normal operating position;

FIG. 12 is a similar view of the system of FIG. 11, but with the post moved vertically upwardly within the sleeve in response to engagement of the housing with an obstruction;

FIG. 13 is a partial top plan view of the system, as seen along broken lines 13—13 of FIG. 11;

FIG. 14 is a partial elevational view of the aft end of the boat, as seen along broken lines 14—14 of FIG. 11; and FIG. 15 is a vertical sectional view of a boat having a steering and propulsion system constructed in accordance with another form of the last-mentioned embodiments which is quite similar to that of FIGS. 11 to 14, and wherein the actuator has been moved to retracted position so as to raise the propeller from its normal operating position.

Figure 2:
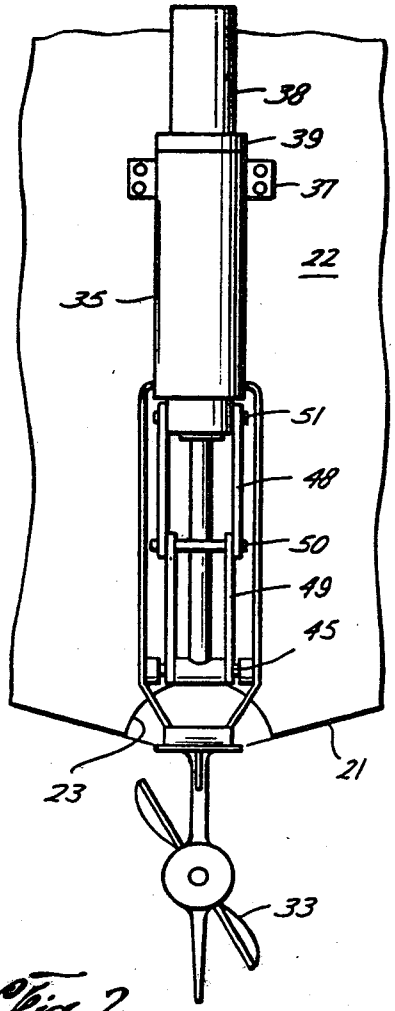
FIG. 2 is a rear end view of the transom of the boat and the steering and propulsion system of FIG. 1.

With reference now to the details of the above-described drawings, and particularly FIGS. 1 to 4, the embodiment of the invention illustrated therein comprises a boat having a hull 20 including a bottom 21 and a transom 22 across the rear end of the hull. In this particular embodiment of the invention, the bottom 21 of the hull has a tunnel 23 which extends centrally along its rearward portion and opens to the lower end of the transom, as best shown in FIG. 2. A motor 24, which preferably comprises a four cycle engine, is mounted in and extends longitudinally of the boat hull, as shown in broken lines in FIGS. 1, 2 and 4, with its output shaft connected to reversing gears within a box 25 by means of a belt or chain drive.

A drive shaft 27 has its forward end connected to the output 26 of the reversing gear box 25 by means of a universal joint 28 and extends rearwardly therefrom through a hole 29 in the hull on the forward end of tunnel 23 generally in line with tunnel 23. A flexible boot or sleeve 30 is secured to the hull about the hole 29 to form a flexible seal about the shaft 27, thereby sealing the hole against the ingress of water, and thus protecting the "U" joint 28. Another "U" joint 31 on the rearward end of shaft 27 connects with the forward end of a shaft 32 for a propeller 33 which is mounted by suitable bearings within the lower end of housing 34.

Both "U" joints 28 and 31 are preferably of the constant velocity variety, such as those manufactured and sold by Dana Corporation of Toledo, Ohio, and known as "CON-VEL" joints. However, this invention contemplates that one or both of the joints may instead be of the double yoke type, such as shown and described in U.S. Pat. No. 3,376,842, or of the type shown and described in U.S. Pat. No. 3,180,880. The constant velocity "U" joint is preferred, however, because it is self-supporting—i.e., drive shaft 27 intermediate the "U" joints need not be provided with an intermediate support.

Since forward "U" joint 28 is inside sleeve 30, it need not be sealed. Ordinarly, rearward "U" joint 31 would, on the other hand, require sealing as would the bearings for the propeller shaft, although the use of more exotic materials may permit the "U" joint to operate in the water. These, however, represent only a fraction of the parts requiring sealing and maintenance in prior stern drive systems.

Propeller housing 34 is supported in the position shown rearwardly of transom 22 by means which includes a sleeve 35 pivotally connected by a pin 36 to a bracket 37 on the transom for swinging about a horizontal axis generally transverse to the length of the boat hull, and a post 38 which is received closely and supported for rotation within the sleeve. More particularly, a steering arm 39 rests upon the upper end of the sleeve 35 and extends forwardly through a hole 40 in the transom to dispose a knob 41 on its inner end in position to be manipulated from within the hull so as to rotate the post about the substantially vertical axis of the sleeve 35.

As previously described, in this embodiment of the invention, housing 34 is connected to the post 38 for rotation therewith so that rotation imparted to the post 38 by manipulation of arm 39 will in turn rotate the propeller housing, and thus the propeller so as to steer th boat. As also previously described, the housing is connected to the post for generally vertical movement with respect thereto along the axis of the supporting sleeve. Thus, the propeller housing may be raised from its lowermost position of FIG. 1, in which the propeller 33 is disposed in a generally operating position, to the uppermost position of FIGS. 3 and 4, in which shaft 27 moves into tunnel 23 so as to retract the propeller for transport purposes or for operating in shallow water, as shown in FIG. 3, or to permit the propeller housing to move over an obstruction in the water, as shown in FIG. 4. As will also be described to follow, the housing may be raised to an intermediate position to dispose the propeller in trim position.

The propeller housing is raised and lowered by means of an extendible and retractable actuator 42 connected at its upper end to the post 38 and to its lower end to the propeller housing. As shown, the post is hollow and the actuator is fluid-operated and includes a cylinder 43 received closely and supported within the lower end of the post 38 by means of a snap ring carried in lower end of the post, and a rod **43*a* extending downwardly from a piston within the cylinder and pivotally connected at its lower end to the propeller housing by means of a pin 45. With the actuator extended, as shown in FIG. 1, the cylinder is effectively connected to the post by engagement of its upper end with a spring-pressed ball detent 44 carried by the sleeve which holds its lower end down against the snap ring so as to locate propeller housing in its lowermost position and the propeller in its normal operating position. However, upon retraction of the rod, as shown in FIG. 3, the housing is raised to retract the propeller, either to a position intermediate the lowermost position of FIG. 1 and the uppermost position of FIG. 3, when it is desired to position the propeller in trim position, or to a fully retracted position. This selective extension and retraction of the fluid actuator is made possible by means of fluid line 46 leading to the rod or lower side of the piston and fluid line 47 connecting with a hollow portion of the rod 43*a*** leading to the upper side of the piston. Suitable controls may be provided for selectively exhausting and supplying pressure fluid to opposite sides of the piston from a suitable source of pressure fluid on board the boat.

Rotation of post 38 is transmitted to propeller housing 34 by means of links 48 and 49 pivotally connected to one another by pin 50, to post 38 by pins 51, and to the propeller housing by means of the aforementioned pins 45, all of the pins being disposed along generally horizontal axes to permit the linkage to collapse and expand in scissors fashion upon extension and retraction of the actuator.

When the lower end of the housing engages a solid obstruction, as shown in FIG. 4, the spring pressure of the ball detent 44 is overcome to permit the entire actuator to move upwardly, as shown in FIG. 4. This upward movement of the actuator within the post is resisted by a spring 52 which is disposed between the top of cylinder 43 and the upper closed end of post 38, so that the actuator is returned to its lower position of FIG. 1, as the housing passes over the obstruction. At this time, the ball detent 44 is reengaged to hold the cylinder down in its lowermost position in the post.

As shown, the rearward universal joint 31 is mounted along the front edge of the propeller housing, and thus somewhat forwardly of the steering axis of the propeller housing. As a consequence, the front edge of the propeller housing, and thus the rearward "U" joint, will be free to swing about the horizontal axis of forward "U" joint 28 a small lateral distance to each side of the center line of tunnel 23. As will be shown in FIG. 2, however, the tunnel is of sufficient width to accommodate such lateral shifting. Also, of course, hole 29 is of sufficient size as to accommodate this lateral movement of the shaft as well as tilting of the shaft during raising and lowering of the propeller housing.

The embodiment of the invention illustrated in FIGS. 5 and 6 is in many respects identical to that of FIGS. 1 to 4. Thus, propeller housing 34A is supported from the hull 21A of the boat 20A in such a manner that it may be steered and raised and lowered by means generally identical in construction and operation to that of FIGS. 1 to 4. In addition, the boat hull has a tunnel 23A into which a drive shaft 27A is moved when the propeller housing is raised, as shown in FIG. 6, whether this be by virtue of the engagement of the lower end of the housing with an obstruction in the water, or due to the retraction of the actuator.

In this particular embodiment, however, drive shaft 27A is an extension of the output of a right angle gear box 25A which, as distinguished from the fixedly mounted gear box 25, has its input shaft rotatably mounted in trunnions fixed to the hull, so as to permit the box to tilt about a horizontal, generally transverse axis. The input shaft is in turn connected to the output of motor 24A by a belt or chain which maintains driving engagement between them regardless of the rotative position of the gear box. Although conventional right angle drives, preferably including suitable reversing mechanisms, may be found suitable for this purpose, one that is believed to be especially suitable is illustrated on the first page of a parts catalogue for the "Aquamatic 270" style drive sold by the Glastron Boat Company, of Austin, Texas.

In any event, tilting of the gear box replaces the flexing function of the forward "U" joint of FIGS. 1 to 4 in permitting the shaft 27A to swing between the downwardly extending position of FIG. 5, in which the propeller is disposed in normal operating position, and the upper generally horizontal position of FIG. 6, wherein it is disposed within the tunnel 23A, and the propeller is in a retracted position, as shown in FIG. 6.

In this case, of course, the rearward end of shaft 27A is not free to move laterally out of a position aligned with the center of the tunnel 23. Consequently, in this form of the invention, the center of the rearward "U" joint 31A must be aligned with the steering axis SA of the propeller housing. This, however, merely requires that the sleeve 35A, post 38A, and actuator contained therein may be angled somewhat from the positions of FIGS. 1 to 4.

With reference now to the embodiment of the invention illustrated in FIGS. 7 and 8, the boat 20B may be identical to that described in connection with embodiments of FIGS. 1 to 4 and 5 and 6 in that it includes a hull 21B having a transom 22B across its rear end and a tunnel 23B formed in the bottom 21B in substantial alignment with and centrally of the length of the boat. Also, as in the case of the embodiment of FIGS. 1 to 4 a motor 24B which may comprise a four cycle engine, is mounted within the hull of the boat. However, as shown in broken lines in FIG. 7, the motor extends transversely of the length of the boat hull, and has an output shaft connecting with the input shaft of a reversing gear box 25B by a belt or chain drive. As in the case of the embodiment of FIGS. 1 to 4, the gear box is fixedly mounted in the boat hull, and has an output shaft 26B adapted to connect with a drive shaft 27B which extends through a hole 29B formed in the bottom of the hull and at the front end of tunnel 23B.

The steering and propulsion unit system of this embodiment of the invention also includes a housing 34B in which a shaft 32B for a propeller 33B is rotatably mounted and connected to the rear end of drive shaft 27B by a "U" joint 31B, in the same manner as shown and described in connection with the previous embodiments. Also, the propeller housing is supported rearwardly of transom 22B by means which permits it to be swung about a vertical axis for steering purposes and to pivot about a horizontal axis extending generally transversely to the length of the boat to permit the propeller housing to be raised and lowered, and thus permit the propeller 33B to be moved between the normal operating position of FIG. 7 and a retracted position, as well as a trim position intermediate the two.

This support includes a slide 55 mounted on the rear wall of the boat transom 22B, a guide 56 guidably slidable within the slide in a generally vertical direction, and a means comprising an extendible and retractable fluid actuator 57 connected at its lower end to housing 34 and having an enlarged head 58 on its upper end pivotally connected to slide 56 by means of a pivot pin 59. More particularly, the actuator 57 includes a piston 60 reciprocable within a cylinder 61 fixed at its lower end to the housing and a rod 62 on the piston connected to the enlarged head 58 on its upper end. More particularly, the piston is not only reciprocable in the cylinder to permit extension and retraction of the actuator, but the cylinder 61 is also rotatable with respect to the piston so as to permit the propeller housing 34B to which it is fixed to be rotated about the axis of the actuator.

This rotation is imparted to the propeller housing in order to steer the boat by means of a steering arm 63 which is rotatably mounted about the upper end of piston rod 62 for extension forwardly through a hole in the transom 22B. More particularly, the arm is guidably received in an opening in the transom, and thus supported in a manner which permits rod 62 to slide vertically through its head 58, and a handle 65 on the inner end of arm 63 is positioned for manual manipulation from within the boat hull.

The rearward end of arm 63 is connected to cylinder 61 of the actuator by means of links 66 and 67 which are pivotally connected to one another by means of a pivot pin 68 and to the arm and the cylinder, respectively, by means of pivot pins 68A and 68B. Thus, as in the manner described in the embodiments of FIGS. 1 to 6, the linkage is collapsible and expandable to permit generally vertical movement of the propeller housing while connected to the steering arm for rotation with the steering arm 63 about the axis of rotation defined by the actuator 57.

In this form, as in the previously described embodiments, a propeller housing 34B is not only selectively raised by retraction of the actuator, so as to dispose the propeller in either a retracted position or a trim position, but also the propeller housing is adapted to be moved upwardly, when the actuator is extended, as shown in FIG. 7, in the event the propeller housing engages an obstruction. In this latter event, of course, the piston rod 62 would slide upwardly through the steering arm 63 as slide 56 slides upwardly within guide 55, the frictional resistance of the guide together with the weight of the housing and its associated parts normally preventing this upward movement. Upon passage over the obstruction, the weight of these parts would normally be expected to return them to their lowered position of FIG. 7, although a downwardly directed spring force may be added for this purpose.

As previously mentioned, this embodiment of the invention differs from those previously described in that the extent to which the propeller housing swings upwardly and outwardly as it is raised is controlled not by the length of drive shaft 27B, but rather by means of a control arm 70 connecting the propeller housing to the transom generally intermediate its upper and lower ends, and in any event above the propeller shaft 32B. As shown, this arm is V-shaped having forward ends pivotally connected by pins 71 to bracket 72 secured to the transom, and its apex pivotally connected to the front edge of the propeller housing 34B by a universal joint 73. More particularly, the "U" joint is disposed at a lower level than pins 71 and is located with its center in alignment with the steering axis of the actuator 57.

Since the swinging movement of the propeller housing is controlled by arm 70, drive shaft 27B differs from the drive shafts of the previously described embodiments in that it includes a telescoping joint 74 intermediate a "U" joint 28B connecting its forward end to gear box output shaft 26 and "U" joint 31B at its rearward end connecting it to propeller shaft 32B.

In the embodiment of the invention illustrated in FIGS. 9 and 10, the boat 20C includes, as in previous embodiments, a hull 21C having a transom 22C across the rear end. However, as distinguished from the previous embodiments, the bottom of the hull does not have a tunnel formed therein and a drive shaft 27C connecting a transversely extending motor 24C to a propeller housing 34C passes through a hole 29C in the transom and is of shorter extent than those previously described. As a result, the gear box may be fixedly mounted in a more rearwardly position in the boat hull, with the output shaft of the motor connected with the input shaft of a gear box 25C whose output shaft 26C is connected to the forward end of the drive shaft. In this particular form, as in the embodiments of FIGS. 1 to 4 and 7 and 8, the forward end of drive shaft 27C is connected to the output shaft of the gear box by means of a forward universal joint 28C and to propeller shaft 32C, which is rotatably mounted in the housing 34C, by means of a rearward "U" joint 31C. A flexible boot or sleeve 30C is mounted to the boat hull about the hole through which the shaft extends to form a flexible seal about shaft 27C.

This embodiment of FIGS. 9 and 10 is similar to those of FIGS. 1 to 6 in that drive shaft 27C is of fixed length intermediate the joints at its opposite ends so as to control the path in which the propeller housing moves as it is raised and lowered. Also, the means by which housing 34C is supported in order to permit it to be raised and lowered as well as steered is similar to that previously described in connection with the embodiments of FIGS. 1 to 6 in that it includes a sleeve 75 pivotally connected by pin 77 to a bracket 76 secured to the transom 22 for swinging about a horizontal axis generally transverse to the length of the boat hull. More particularly, the sleeve closely receives and rotatably supports a post 78 having an arm 79 extending through an enlarged hole in the transom 22, and a knob or grip 80 is provided on the upper side of the post so as to permit rotation of the post 78 within and about the generally vertically extending axis of sleeve 75 by manual manipulation from within the boat.

Propeller housing 34C is connected to post 78 for rotation therewith and vertical reciprocation with respect thereto in order that it may be steered and raised and lowered between the positions of FIGS. 9 and 10. For this purpose, the post is hollow and closely receives an inner tube 81 for vertical reciprocation with respect to the post and for rotation therewith through splines 82 formed on the exterior of the tube and the interior of the post. The connecting means further includes an extendible and retractable fluid actuator 83 received within the tube 81 and including a cylinder 84 fixedly connected at its lower end to propeller housing 34C and a piston 85 reciprocable therein and having a rod 86 extending therefrom for connection at its upper end to a cap 87 across the upper end of hollow post 78. Hydraulic fluid is supplied and exhausted from the cylinder beneath the piston by means of a hose 88, and is supplied to and exhausted from the rod side of piston 85 by means of a hose 89. More particularly, cylinder 84 is welded at 90 to the lower end of tube 81, so that, upon retraction of the actuator, the tube is raised within hollow post 78 so as to in turn raise the propeller 33C from its normal operating position of FIG. 9 to either its uppermost retracted position of FIG. 10 or an intermediate trim position therebetween.

Tube 81 is yieldably urged to its lowermost position by means of a coil spring 91 disposed within post 78 and acting between the cap 87 and the upper end of the tube 81. When the actuator 83 is extended, as shown in FIG. 9, the coil spring 91 will, with the aid of the weight of the housing, normally maintain the propeller 33C in its operating position. However, fluid line 88 connects with a pressure relief valve (not shown) which is adapted to open so as to exhaust pressurre fluid from the lower side of piston 85 in the event propeller housing 34C engages an obstruction, whereby the actuator may be retracted to permit the housing to rise upon engagement of the obstruction. If rod 86 were free to slide vertically through cap 87, the relief valve could be eliminated, although this might require a larger hole through the transom to receive the extended rod.

After the housing has moved over the obstruction, coil spring 91 and the weight of the housing will be effective to return tube 81 to its lowermost position, as shown in FIG. 9, and the relief valve will close to permit pressure fluid in line 88 to return the actuator to extended position, and thus lower the housing back to the position of FIG. 9.

As previously described, the embodiments of the invention illustrated in FIGS. 11 to 14 and 15 are similar, in many respects, to certain of the previously described embodiments. Thus, for example, one such form shown in FIGS. 11 to 14 comprises a boat having a hull 20D including a bottom 21D and a transom 22D across the rear end of the hull. As in the case of the embodiments of FIGS. 1 to 8, the bottom of the hull has a tunnel 23D which extends centrally along its rearward portion and opens to the lower end of the hull. This tunnel differs from those previously described, however, in that it includes, in addition to a relatively narrow upper end 92, a relatively wide lower end 93 which flares outwardly from the upper end 92, as best shown in FIG. 14.

As in the earlier described embodiment of FIGS. 1 to 4, a motor 24D is mounted in the boat hull for extension longitudinally thereof, with its output shaft having a belt or chain drive to the input shaft of a gear box 25D. As also previously described, the gear box may have suitable reversing gears therein, and its input and output shafts are in line.

A drive shaft 27D has its forward end connected to the output 26D of the reversing gear box by means of a universal joint 28D, and extends rearwardly therefrom through a hole 29D in the hull on the forward end of the tunnel 23D. A flexible boot or sleeve 30D is secured to the hull about the hole 29D to form a flexible seal about the shaft 27D. Another universal joint 31D on the rearward end of the shaft 27D connects with the forward end of a shaft 32D for a propeller 33D which is mounted by suitable bearings within the lower end of a housing 34D. The universal joints may be of the construction previously described in connection with the embodiment of FIGS. 1 to 4.

Propeller housing 34D is supported rearwardly of transom 22D by means which includes a sleeve 94 pivotally connected by pins 95 to brackets 96 (see FIG. 13) on the transom for swinging about a horizontal axis generally transverse to the length of the hull. A post 97 is carried by the sleeve for rotation withh respect to it about a substantially vertical axis and for vertical reciprocation with respect thereto along such axis, and the lower end of the post is connected to the upper end of housing 34D so that the housing is vertically reciprocable and rotatable with the post. More particularly, and as best shown in FIG. 13, the post 97 is square in cross section, and the opening in the sleeve through which the post extends is of a diameter at least as great as the diagonal distance across the post, whereby the post is, as mentioned, free to both rotate and reciprocate vertically with respect to the sleeve.

As shown in FIG. 13, the post is preferably hollow so that, if desired, it may be used to conduct exhaust gases from the motor to the housing and on out an exhaust outlet in the propeller.

A steering arm 97A is supported upon the upper end of the sleeve and extends forwardly through a hole 98 in the transom 22D to dispose a knob 99 on its inner end within the hull. The outer end of the arm is provided with a square opening for closely fitting over the square upper end of post 97, so that the arm may be manipulated from within the hull to steer the boat by rotating the post and thus the housing 34D. Inasmuch as the post is vertically reciprocable within the sleeve, the propeller is free to move upwardly, as shown in FIG. 12, and thus avoid damage to the propeller 33D and other parts of the system in the event it hits an obstruction.

As also previously described, propeller housing 34D may be raised and lowered between its normal operating position of FIG. 11 and an elevated position, in which shaft 27D is disposed within tunnel 23D for transport purposes or for operating in shallow water, by means of an extendible and retractable actuator 100 disposed in side-by-side relation with the sleeve 94 and post 97. The lower end of the actuator, which comprises a cylinder 101, is connected to and upstands from the upper end of housing 34D. The upper end of the actuator, which is a rod 102 having a piston 103 on its lower end reciprocable within cylinder 101, is so connected to sleeve 94 that when the actuator is extended, as shown in FIGS. 11 and 12, the post 97 is free to rise in the sleeve, and when piston 103 is depressed to move the actuator from extended to retracted position, as will be apparent from FIG. 15, the post is raised within the sleeve so as to retract the housing. Thus, as shown, piston rod 102 is vertically slidable within a hole in a plate 103A at the upper end of sleeve 94, and a nut 104 is connected to the upper end of the rod for resting on the upper surface of plate 103A when the actuator is extended and the housing 34D is in its lower operating position.

The embodiment of the invention illustrated in FIG. 15 is substantially identical to that above described in connection with FIGS. 1 to 14, except as to the manner in which the drive shaft thereof is connected between the gear box and the propeller shaft of the housing. Hence, for purposes of simplicity, those parts of the system of FIG. 15 which are, for all intents and purposes, the same as FIGS. 11 and 14, both in construction and function, are designated in the drawings by reference characters identical to those of FIGS. 11 and 14, except for the use of the suffix "E" in place of the suffix "D" in the case of reference characters 20 through 34.

As in the case of the embodiment of FIGS. 11 to 14, drive shaft 27E has a universal joint 28E at its forward end connected to the output shaft 26E of gear box 25E and a univeral joint 31E at its rearward end connected to the shaft 32E for propeller 33E which is supported by suitable bearings in propeller housing 34E. However, as compared with the drive shaft of FIGS. 11 to 14, drive shaft 27E is housed within a sleeve 105 having bearings 107 which surround the drive shaft. The forward end of the sleeve 105 extends through hole 29E in the boat hull, and a boot or sleeve 30E is secured to the hull 21E about opening 29E and surrounds the forward end of the sleeve 105 to protect forward "U" joint 28E. A skeg 106 is mounted on the rearward portion of the sleeve adjacent the front end of housing 34E so as to protect the propeller 33E and other submerged parts of the housing.

The rear end of sleeve 105 extends into a recess 109 in the rearward end of the skeg, and a boot or sleeve 110 is secured to the opening in the bearing housing through which propeller shaft 32E extends and surrounds the rearward portion of the sleeve 105 so as to protect the rearward universal joint 31E against the intrusion of water.

As previously mentioned, FIG. 15 shows actuator 100 in its retracted position so as to raise the propeller housing 34E from its normal operating position, such as that shown in FIG. 11, to a retracted position in which the shaft 27E and its housing are disposed within the upper end of the tunnel 92A.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A motor boat, comprising a boat hull having a transom, a motor mounted in the hull, a housing and a propeller having a shaft rotatably mounted in the housing, means supporting the housing from the hull and rearwardly of its transom, means extending sealably through a hole in the hull to connect the motor to the propeller shaft, including a drive shaft having a flexible joint near the hole which connects to the motor to permit the drive shaft to swing about a horizontal axis generally transverse to the length of the hull, and a universal joint at its opposite end which connects it to the propeller shaft, said supporting means including a first part mounted on the transom for pivoting about a horizontal axis transverse to the direction of travel of the hull, a second part connected to the propeller housing and so supported from the first part as to permit said housing to be rotated with respect to the hull about an axis which is fixed against lateral displacement and raised and lowered with respect to said first part generally along said axis of rotation, and steering means connectable to the second part and restrained for limited vertical movement with respect to said hull, whereby the boat may be steered by means of the propeller.

2. A motor boat of the character defined in claim 1, wherein said supporting means also includes means for reciprocating the housing to raise and lower the propeller and hold it in the position to which it has been raised or lowered.

3. A motor boat of the character defined in claim 1, wherein said supporting means also includes means yieldably holding the housing against upward movement.

4. A motor boat of the character defined in claim 3, wherein said supporting means also includes means for reciprocating the housing to raise and lower the propeller and hold it in the position to which it has been raised or lowered.

5. A motor boat of the character defined in claim 1, wherein the hull has a tunnel in the bottom thereof, and the hole is through the forward end of the tunnel.

6. A motor boat of the character defined in claim 1, wherein the hole through which the shaft extends is in the transom near the bottom of the hull.

7. A motor boat of the character defined in claim 1, wherein the flexible joint is a universal joint.

8. A motor boat of the character defined in claim 1, wherein the flexible joint is a gear box which is mounted in the hull for tilting about the transverse axis of an input shaft connected with the output of the motor, and the drive shaft extends from the box at a right angle to the input shaft.

9. A motor boat of the character defined in claim 1, wherein the means to steer the boat comprises a tiller manipulatable within the boat hull.

10. A motor boat of the character defined in claim 1, wherein the first part comprises a sleeve, and the second part comprises an elongate member having its lower end fixed to the housing and its upper end vertically reciprocable but not rotatable within the sleeve.

11. A motor boat of the character defined in claim 1, wherein the first part is a sleeve, and the second part comprises an elongate member rotatable within the sleeve and an axially expandible and contractible, but not rotatable, connection between the lower end of said member and the housing.

12. A motor boat of the character defined in claim 1, wherein said supporting means comprises a bracket which is guidably reciprocable along the rear of the transom in a generally vertical direction, the first part comprises a rod pivoted to the bracket, and the second part includes an expandible and retractible connection having means on its upper end rotatable about the rod and means on its lower end fixed to the housing.

13. A motor boat, comprising a boat hull having a transom, a motor mounted in the hull, a housing and a propeller having a shaft rotatably mounted in the lower end of the housing, means supporting the housing from the hull and rearwardly of its transom, means including a drive shaft extending sealably through a hole in the hull to connect the motor to the propeller shaft, and said drive shaft having a flexible joint near the hole which connects to the motor to permit the drive shaft to swing about a horizontal axis generally transverse to the length of the hull, and a universal joint at its opposite end which connects it to the propeller shaft, said supporting means including a first part mounted on the transom for pivoting about a horizontal axis transverse to the direction of travel of the hull, a second part connected to the propeller housing and so supported from the first part as to permit said housing to be rotated with respect to the hull about an axis which is fixed against lateral displacement and raised and lowered with respect to said first part generally along said axis of rotation, and steering means connectable to the second part and restrained for limited vertical movement with respect to said hull whereby the boat may be steered by means of the propeller.

14. A motor boat of the character defined in claim 13, wherein said supporting means also includes means for reciprocating the housing to raise and lower the propeller and hold it in the position to which it has been raised or lowered.

15. A motor boat of the character defined in claim 13, wherein said supporting means also includes means yieldably holding the housing against upward movement.

16. A motor boat of the character defined in claim 15, wherein said supporting means also includes means for reciprocating the housing to raise and lower the propeller and hold it in the position to which it has been raised or lowered.

17. A motor boat of the character defined in claim 13, wherein said drive shaft is of fixed length intermediate said joints.

18. A motor boat, comprising a boat hull having a transom, a motor mounted in the hull, a housing and a propeller having a shaft rotatably mounted in the housing, means supporting the housing from the hull and rearwardly of its transom, means extending sealably through a hole in the hull to connect the motor to the propeller shaft, including a drive shaft having a flexible joint near the hole which connects to the motor to permit the drive shaft to swing about a horizontal axis generally transverse to the length of the hull, means on the hull above the hole forming a flexible seal about the shaft, and a universal joint at its opposite end which connects it to the propeller shaft, said supporting means including a first part mounted on the transom for pivoting about a horizontal axis transverse to the direction of travel of the hull, a second part connected to the propeller housing and so supported from the first part as to permit said housing to be rotated with respect to the hull about an axis which is fixed against lateral displacement and raised and lowered with respect to said first part generally along said axis of rotation, and steering means connectable to the second part and restrained for limited vertical movement with respect to said hull, whereby the boat may be steered by means of the propeller.

19. A motor boat of the character defined in claim 18, wherein said supporting means includes means for reciprocating the housing to raise and lower the propeller and hold it in the position to which is has been raised or lowered.

20. A motor boat of the character defined in claim 18, wherein said supporting means also includes means yieldably holding the housing against upward movement.

21. A motor boat of the character defined in claim 20, wherein said supporting means also includes means for reciprocating the housing to raise and lower the propeller and hold it in the position to which it has been raised or lowered.

22. A motor boat, comprising a boat hull having a transom, a motor mounted in the hull, a housing and a propeller having a shaft rotatably mounted in the housing, means supporting the housing from the hull and rearwardly of its transom, means including a drive shaft extending sealably through a hole in the hull to connect the motor to the propeller shaft, means on the hull about the hole forming a flexible seal about the drive shaft, said drive shaft having a flexible joint within the hull and seal and near the hole which connects to the motor to permit the drive shaft to swing about a horizontal axis generally transverse to the length of the hull, and a universal joint at its opposite end which connects it to the propeller shaft, said supporting means including a first part mounted on the transom for pivoting about a horizontal axis transverse to the direction of travel of the hull, a second part connected to the propeller housing and so supported from the first part as to permit said housing to be rotated with respect to the hull about an axis which is fixed against lateral displacement and raised and lowered with respect to said first part generally along said axis of rotation, and steering means connectable to the second part and restrained for limited vertical movement with respect to said hull, whereby the boat may be steered by means of the propeller.

23. A motor boat of the character defined in claim 22, wheein said supporting means also includes means for reciprocating the housing to raise and lower the propeller and hold it in the position to which it has been raised or lowered.

24. A motor boat of the character defined in claim 22, wherein said supporting means also includes means yieldably holding the housing against upward movement.

25. A motor boat of the character defined in claim 22, wherein said drive shaft is of fixed length intermediate said joints.

26. A motor boat, comprising a boat hull having a transom, a motor mounted in the hull, a housing and a propeller having a shaft rotatably mounted in the housing, a sleeve mounted on the transom for pivoting about a horizontal axis generally transverse to the length of the hull, a post carried by the sleeve for rotation about a substantially vertical axis, means for connecting the housing to the post for rotation therewith and vertical reciprocation with respect thereto, and means extending sealably through a hole in the hull and connecting the motor to the propeller shaft, including a drive shaft having a flexible joint near the hole which connects to the motor to permit the drive shaft to swing about a horizontal axis generally transverse to the length of the hull and a universal joint at its opposite end which connects it to the propeller shaft.

27. A motor boat of the character defined in claim 26, wherein the connecting means comprises links connected to one another and to the post and housing for pivoting about horizontal axes generally transverse to the length of the hull.

28. A motor boat of the character defined in claim 27, wherein the post is tubular, a tube is received within the post for reciprocation with respect thereto, and the connecting means includes an extendible and retractable actuator within the tube having one end thereof connected to the housing and the tube and the other end thereof connected to the post so that retraction of the actuator lifts the post.

29. A motor boat of the character defined in claim 28, wherein the connecting means comprise a spline between the tube and post.

30. A motor boat of the character defined in claim 26, wherein the post is tubular, and the connecting means includes an extendible and retractable actuator within the tubular post having its ends connected to the post and the housing so that retraction of the actuator raises the housing.

31. A motor boat of the character defined in claim 30, wherein the connecting means comprises links connected to one another and to the post and housing for pivoting about horizontal axes generally transverse to the length of the hull.

32. A motor boat of the character defined in claim 30, wherein the actuator is connected to the sleeve by a releasable detent, and a resilient means is disposed between said actuator and the sleeve to resist upward movement of the actuator upon release of the detent.

33. A motor boat of the character defined in claim 30, wherein the connecting means comprises links connected to one another and to the post and housing for pivoting about horizontal axes generally transverse to the length of the hull.

34. A motor boat, comprising a boat hull having a transom, a motor mounted in the hull, a housing and a propeller having a shaft rotatably mounted in the housing, means supporting the housing from the hull and rearwardly of its transom, including a generally vertically extending guide on the transom, a slide guidably slidable in the guide, means connecting the housing to the slide for rotation with respect thereto and vertical reciprocation therewith, and means extending sealably through a hole in the hull and connecting the motor to the propeller shaft, including a drive shaft having a flexible joint near the hole which connects to the motor to permit the drive shaft to swing about a horizontal axis generally transverse to the length of the hull, and a universal joint at its opposite end which connects it to the propeller shaft.

35. A motor boat of the character defined in claim 34, wherein the connecting means includes means for reciprocating the housing with respect to the slide to raise and lower the propeller and hold it in the position to which it has been raised or lowered.

36. A motor boat of the character defined in claim 35, wherein the connecting means comprises an extendible and retractable actuator having its upper end pivotally connected to the slide and its lower end rotatable with respect to its upper end and fixedly connected to the housing, a steering arm is rotatably mounted on said upper end of the actuator, and links are connected to one another and to each of the arm and lower end of the actuator for pivoting about a horizontal axis generally transverse to the length of the hull, so as to transmit the steering motion of the arm to said housing.

37. A motor boat, comprising a boat hull having a transom, a motor mounted in the hull, a housing and a propeller having a shaft rotatably mounted in the housing, a sleeve mounted on the transom for pivoting about a horizontal axis generally transverse to the length of the hull, a post carried by the sleeve for rotation with respect thereto about a substantially vertical axis which is fixed against lateral displacement and for vertical reciprocation with respect thereto generally along said substantially vertical axis, means connecting the housing to the post for rotation and reciprocation therewith, steering means connectable to the post and restrained for limited vertical movement with respect to said hull, to permit the propeller to be used to steer the boat regardless of the vertical position of the housing with respect to the boat hull, and means extending sealably through a hole in the hull and connecting the motor to the propeller shaft, including a drive shaft having a flexible joint near the hole which connects to the motor to permit the drive shaft to swing about a horizontal axis generally transverse to the length of the hull and a universal joint at its opposite end which connects it to the propeller shaft.

38. A motor boat of the character defined in claim 37, including means for reciprocating the housing with respect to the sleeve in order to raise and lower the propeller and hold it in the position to which it has been raised or lowered.

39. A motor boat, comprising a boat hull having a transom, a motor mounted in the hull, a housing and a propeller having a shaft rotatably mounted in the housing, means supporting the housing from the hull and rearwardly of its transom, means extending sealably through a hole in the hull to connect the motor to the propeller shaft, including a drive shaft having a flexible joint near the hole which connects to the motor to permit the drive shaft to swing about a horizontal axis generally transverse to the length of the hull, and a universal joint at its opposite end which connects it to the propeller shaft, means carried by the housing and surrounding the drive shaft to form a flexible seal about the universal joint, said supporting means including a first part mounted on the transom for pivoting about a horizontal axis transverse to the direction of travel of the hull, a second part connected to the propeller housing and so supported from the first part as to permit said housing to be rotated with respect to the hull about an axis which is fixed against lateral displacement and raised and lowered with respect to said first part generally along said axis of rotation, and steering means connectable to the second part and restrained for limited vertical movement with respect to said hull, whereby the boat may be steered by means of the propeller.

40. A motor boat, comprising a boat hull having a transom, a motor mounted in the hull, a housing and a propeller having a shaft rotatably mounted in the housing, means supporting the housing from the hull and rearwardly of its transom, means including a drive shaft extending sealably through a hole in the hull to connect the motor to the propeller shaft, said drive shaft having a flexible joint near the hole which connects to the motor to permit the drive shaft to swing about a horizontal axis generally transverse to the length of the hull, and a universal joint at its opposite ends which connects it to the propeller shaft, a sleeve surrounding the drive shaft and having bearings therein supporting the drive shaft for rotatiion, and means forming flexible seals between the hull and the sleeve and between the housing and sleeve, said supporting means including a first part mounted on the transom for pivoting about a horizontal axis transverse to the direction of travel of the hull, a second part connected to the propeller housing and so supported from the first part as to permit said housing to be rotated with respect to the hull about an axis which is fixed against lateral displacement and raised and lowered with respect to said first part generally along said axis of rotation, and steering means connectable to the second part and restrained for limited vertical movement with respect to said hull, whereby the boat may be steered by means of the propeller.

41. A motor boat of the character defined in claim 40, including a skeg carried by the rearward end of the sleeve.

42. A motor boat, comprising a boat hull having a transom, a motor mounted in the hull, a housing and a propeller having a shaft rotatably mounted in the lower end of the housing, means supporting the housing from the hull and rearwardly of its transom for pivoting about a horizontal axis extending transverse to the direction of the hull, means including a drive shaft extending sealably through a hole in the hull to connect the motor to the propeller shaft, a control arm having a forward end connected to the hull for swinging about a horizontal axis transverse to the length of the hull and a rearward end universally connected to the housing, said drive shaft having a flexible joint near the hole which connects to the motor to permit the drive shaft to swing about a horizontal axis generally transverse to the length of the hull, a universal joint at its opposite end which connects it to the propeller shaft, and a telescoping connection intermediate the flexible and universal joints, and said supporting means including means permitting said housing to be swung about a generally vertical axis so that the propeller may be used to steer the boat and to reciprocate along a generally vertical axis so that the propeller may be raised and lowered between operating and retracted positions.

43. A motor boat, comprising a boat hull having a transom, a motor mounted in the hull, a housing and a prropeller having a shaft rotatably mounted in the housing, means supporting the housing from the hull rearwardly of its transom for pivoting about a horizontal axis extending transverse to the direction of the hull, means including a drive shaft extending through a hole in the hull to connect the motor to the propeller shaft, means on the hull about the hole forming a flexible seal about the drive shaft, a control arm having a forward end connected to the hull for swinging about a horizontal axis transverse to the length of the hull and a rearward end universally connected to the housing, said drive shaft having a flexible joint within the hull and seal and near the hole which connects to the motor to permit the drive shaft to swing about a horizontal axis generally transverse to the length of the hull, a universal joint at its opposite end which connects it to the propeller shaft, and a telescoping connection intermediate the joints thereof, and said supporting means including means permitting said housing to be swung about a generally vertical axis so that the propeller may be used to steer the boat and to reciprocate along a generally vertical axis so that the propeller may be raised and lowered between operating and retracted positions.

44. A motor boat, comprising a boat hull having a transom, a motor mounted in the hull, a housing and a propeller having a shaft rotatably mounted in the housing, a sleeve mounted on the transom for pivoting about a horizontal axis generally transverse to the length of the hull, a post carried by the sleeve for rotation with respect thereto about a substantially vertical axis and for vertical reciprocation with respect thereto along said substantially vertical axis, means connecting the housing to the post for rotation and reciprocation therewith in order to permit the housing to be swung about said substantially vertical axis to permit the propeller to be used to steer the boat regardless of the vertical position of the housing with respect to the boat hull, means for reciprocating the housing with respect to the sleeve in order to raise and lower the propeller and hold it in the position to which it has been raised or lowered, said reciprocating means comprising an extendible and retractable actuator disposed in side-by-side relation with the sleeve and post, one end of the actuator being connected to the housing and the other end being so connected to the sleeve that, when the actuator is extended, the post is free to rise in the sleeve, and when the actuator is moved from extended to retracted position, the post is raised within the sleeve, and means extending sealably through a hole in the hull and connecting the motor to the propeller shaft, including a drive shaft having a flexible joint near the hole which connects to the motor to permit the drive shaft to swing about a horizontal axis generally transverse to the length of the hull and a universal joint at its opposite end which connects it to the propeller shaft.

45. A motor boat, comprising a boat hull having a transom, a motor mounted in the hull, a housing and a propeller having a shaft rotatably mounted in the housing, a sleeve mounted on the transom for pivoting about a horizontal axis generally transverse to the length of the hull, a post carried by the sleeve for rotation with respect thereto about a substantially vertical axis and for vertical reciprocation with respect thereto along said substantially vertical axis, means connecting the housing to the post for rotation and reciprocation therewith in order to permit the housing to be swung about said substantially vertical axis to permit the propeller to be used to steer the boat regardless of the vertical position of the housing with respect to the boat hull, and means extending sealably through a hole in the hull and connecting the motor to the propeller shaft, including a drive shaft having a flexible joint near the hole which connects to the motor to permit the drive shaft to swing about a horizontal axis generally transverse to the length of the hull and a universal joint at its opposite end which connects it to the propeller shaft, a steering arm supported by the sleeve for rotation with respect thereto, said post being connected to the arm for rotation therewith and vertical reciprocation with respect thereto.

* * * * *